US005722881A

United States Patent [19]

Emerson

[11] Patent Number: 5,722,881

[45] Date of Patent: Mar. 3, 1998

[54] FLAP WHEEL

[75] Inventor: Grahame W. Emerson, Anaheim, Calif.

[73] Assignee: Merit Abrasive Products, Inc., Compton, Calif.

[21] Appl. No.: 706,438

[22] Filed: Aug. 30, 1996

[51] Int. Cl.[6] ..... B24D 13/06

[52] U.S. Cl. ..... 451/466; 451/464; 451/465

[58] Field of Search ..... 451/464, 465, 451/466, 468, 469, 486, 358

[56] References Cited

U.S. PATENT DOCUMENTS

| | | | |
|---|---|---|---|
| 2,819,567 | 1/1958 | Hall | 451/468 |
| 2,907,145 | 10/1959 | Hall et al. | 451/468 |
| 4,646,479 | 3/1987 | Walker et al. | 451/466 |

FOREIGN PATENT DOCUMENTS

| | | | |
|---|---|---|---|
| 446626 | 9/1991 | European Pat. Off. | 451/466 |
| 61-159379 | 7/1986 | Japan | 451/466 |
| 61-226273 | 10/1986 | Japan | 451/466 |

*Primary Examiner*—Eileen P. Morgan
*Attorney, Agent, or Firm*—Ellsworth R. Roston; Fulwider Patton Lee & Utecht, LLP

[57] ABSTRACT

An abrasive wheel is partially defined by a support member and by a plurality of abrasive flaps on such member. A hole is disposed centrally in the support member to receive a mandrel for rotating the wheel. The support member has at its radial periphery an annular surface with a constant radius at progressive positions in the annular direction. The flaps are fixedly supported (as by epoxy) on the annular surface in a partially overlapping relationship between successive pairs of flaps. Each of the flaps has abrasive particles on one of its surfaces. Each of the flaps is disposed on the annular surface of the support member with the abrasive particles facing outwardly from such support surface. Each of the flaps defines an acute angle with the annular surface and extends at its opposite axial ends beyond the axial positions of support by such support surface. However, the flaps are fixedly positioned relative to one another even at the axial positions beyond the opposite axial ends of the annular surface on the support member as a result of the support by the support member and the overlapping relationship between the flaps in the successive pairs. In this way, the abrasive wheel is able to provide a positive and forceful action on a workpiece surface along the full axial width of the flaps when the abrasive wheel is rotated against the workpiece surface.

25 Claims, 3 Drawing Sheets

FIG. 1
PRIOR ART
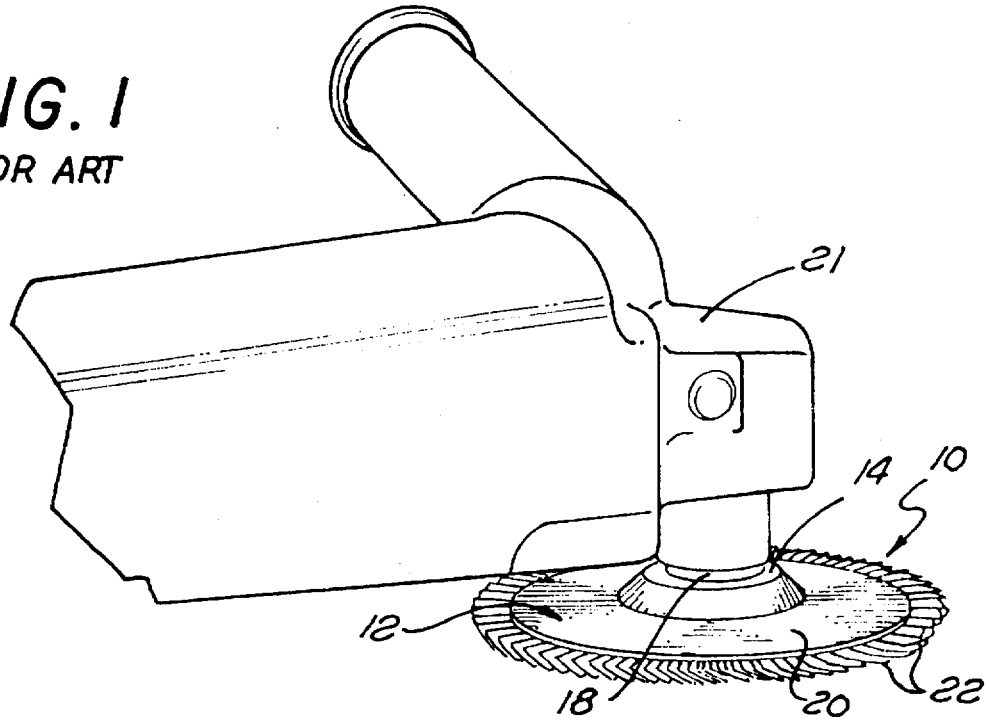
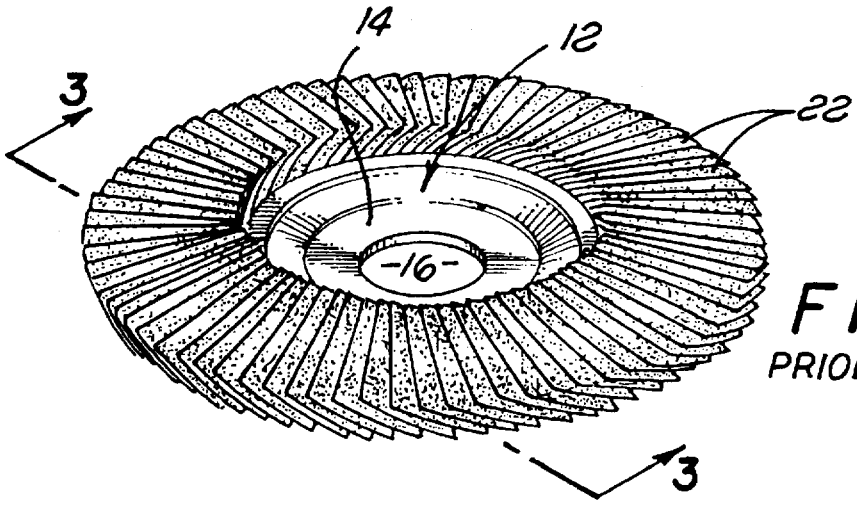
FIG. 2
PRIOR ART
FIG. 3
PRIOR ART
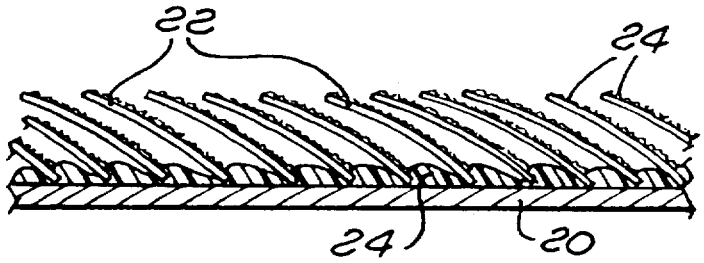

FLAP WHEEL

This invention relates to an abrasive wheel. More particularly, this invention relates to an abrasive wheel in which a plurality of abrasive flaps are axially disposed on one another in a progressive relationship on the radial periphery of a support member and in which the abrasive flaps extend axially beyond the axial ends of the support member.

BACKGROUND OF THE INVENTION

Abrasive wheels have been known for some time. In one type of abrasive wheel of the prior art, a plurality of abrasive flaps have been provided. Each flap has been coated on one side with abrasive particles. In certain embodiments of the prior art, the abrasive wheel has included a radially disposed disc for supporting the flaps.

In such embodiments of the prior art, the flaps have been attached to one surface of the disc so that each flap is disposed at an acute angle relative to the disc and in partially overlapping relationship to the adjacent flap in the plurality. In this relationship, a peripheral portion of each flap extends in an annular direction beyond the flap on which it is disposed. In this way, the progressive flaps define a complete ring.

When the wheel defined by the support disc and the flaps as discussed above rotates while disposed against a workpiece, the exposed portion of each flap abrades the workpiece. The abrasive wheel is advantageous because it is compact and strong and thus provides for a positive and controlled action on the workpiece.

The abrasive wheel discussed above is disadvantageous because it can be used only in a limited manner to abrade workpieces. This results from the disposition of the abrasive flaps on the disc such that the flaps are disposed in a substantially planar relationship on the disc. This limits the abrasive action of the abrasive wheel against workpiece surfaces which are exposed.

Abrasive wheels have also been known in the prior art where a support member has been provided with an annular surface defined by a constant radius at progressive positions on the surface. Abrasive flaps have been provided on this annular surface to abrade a workpiece surface. However, the abrasive flaps have been loosely disposed relative to one another on this annular surface. This loose relationship has limited the effectiveness of the flaps in abrading the workpiece surface. Furthermore, the axial widths of the flaps in such wheels have been limited to the axial widths of the members for supporting the flaps in such wheels.

BRIEF DESCRIPTION OF THE INVENTION

This invention provides an abrasive wheel which combines the best features of the prior art discussed in the previous paragraphs. The abrasive wheel of this invention is able to abrade surfaces not capable of being abraded by the prior art abrasive discs specified in the previous paragraphs. Furthermore, the abrasive wheel of this invention is able to provide a more positive action on such surfaces than the abrasive wheel discussed in the immediately preceding paragraph. The abrasive wheel of this invention is also advantageous because the flaps in such wheel have a greater axial width than the member supporting such flaps. This allows the abrasive wheel to polish workpiece surfaces not capable of being polished by the abrasive wheels and the abrasive disc of the prior art.

In one embodiment of the invention, an abrasive wheel is partially defined by a support member and by a plurality of abrasive flaps on such member. A hole is disposed centrally in the support member to receive a mandrel for rotating the wheel. The support member has at its radial periphery an annular surface with a constant radius at progressive positions in the annular direction. The flaps are fixedly supported (as by epoxy) on the annular surface in a partially overlapping relationship between successive pairs of flaps.

Each of the flaps has abrasive particles on one of its surfaces. Each of the flaps is disposed on the annular surface of the support member with the abrasive particles facing outwardly from such support surface. Each of the flaps defines an acute angle with the annular surface and extends at its opposite axial ends beyond the axial positions of support by such support surface.

The flaps are fixedly positioned relative to one another in the abrasive wheel of this invention even at the axial positions beyond the opposite axial ends of the annular surface on the support member as a result of the support by the support member and the overlapping relationship between the flaps in the successive pairs. In this way, the abrasive wheel is able to provide a positive and forceful action on a workpiece surface along the full axial width of the flaps when the abrasive wheel is rotated against the workpiece surface.

BRIEF DESCRIPTION OF THE DRAWINGS

In the drawings:

FIG. 1 is a schematic perspective view of an abrasive disc of the prior art and of a tool for rotating the abrasive disc with the disc disposed against a workpiece surface;

FIG. 2 is an enlarged perspective view of the abrasive disc shown in FIG. 1;

FIG. 3 is an enlarged fragmentary sectional view taken substantially on the line 3—3 in FIG. 2 and shows on a schematic basis the interrelationship between successive abrasive flaps on one surface of the disc;

DETAILED DESCRIPTION OF THE INVENTION

Figure 4:
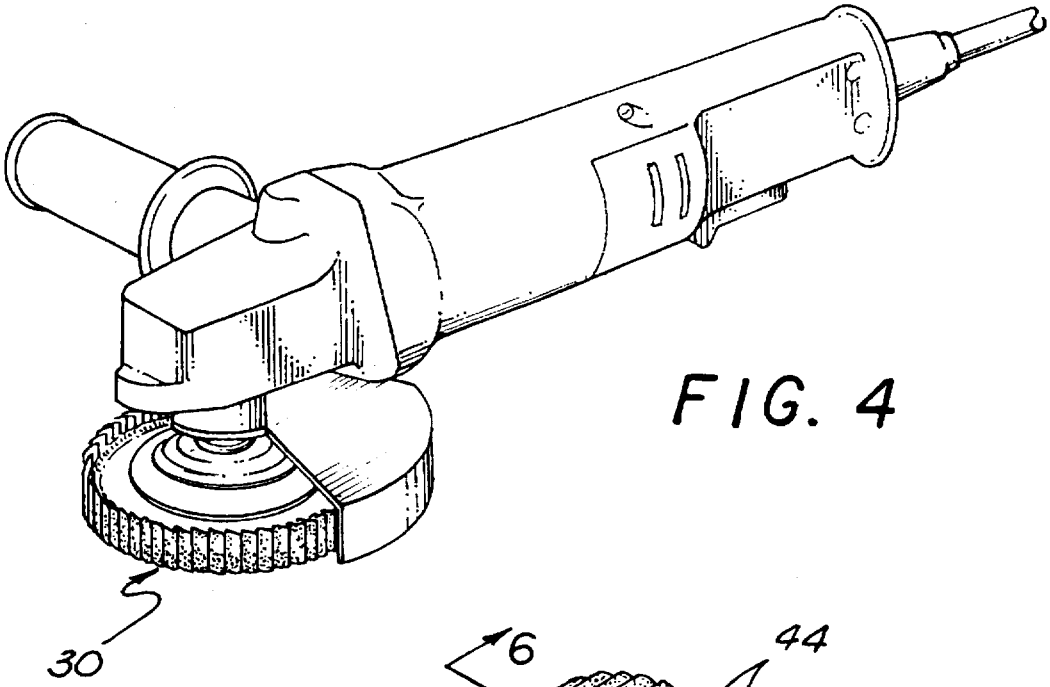
FIG. 4 is a schematic perspective view, similar to that shown in FIG. 1, of an abrasive wheel constituting one embodiment of the invention and a tool for rotating the abrasive wheel with the periphery of the wheel disposed against a workpiece surface.
Figure 5:
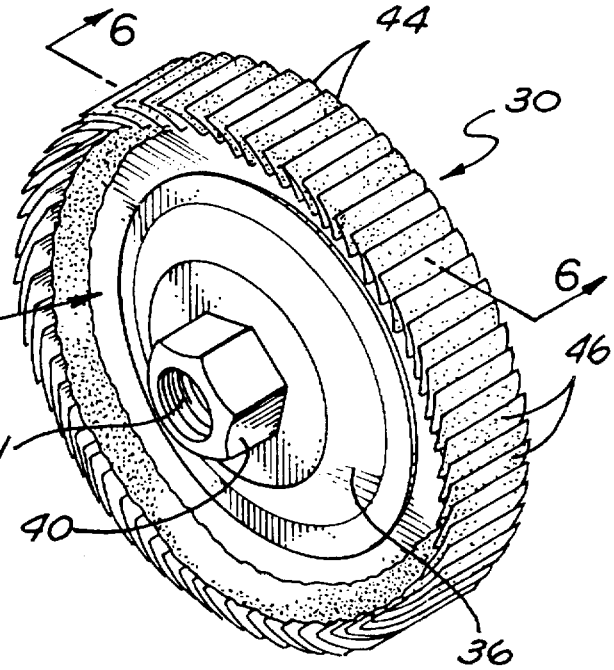
FIG. 5 is an enlarged perspective view of the embodiment of the abrasive wheel shown in FIG. 4 and shows the abrasive flaps and a member for supporting the flaps.
Figure 6:
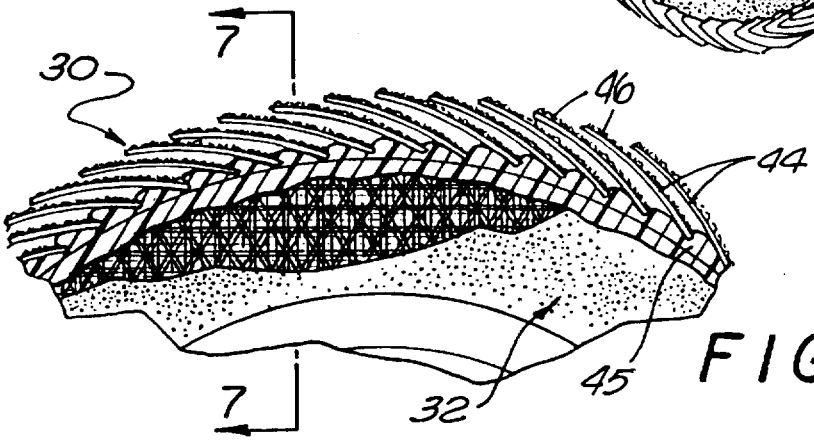
FIG. 6 is an enlarged fragmentary sectional view taken substantially on the line 6—6 in FIG. 5 and shows the support member and the interrelationship between successive flaps on the annular periphery of the wheel and the support member.
Figure 7:
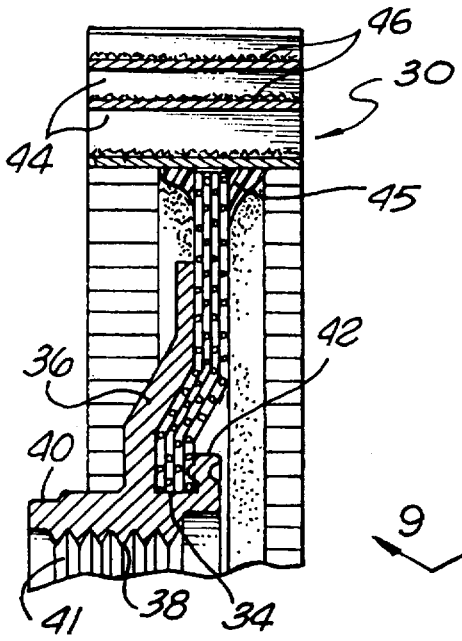
FIG. 7 is an enlarged fragmentary sectional view taken substantially on the line 7—7 of FIG. 6 and shows additional details of the support member and the attachment of the flaps to the support member.

FIGS. 1–3 illustrate an abrasive wheel, generally indicated at 10, of the prior art. The abrasive wheel 10 includes a support plate 12 which may preferably be made of a suitable material such as steel and which may be provided with an annular configuration. The support plate 12 may have an indented central portion 14 with a centrally disposed hole 16 for receiving a mandrel 18 for rotating the support plate.

The support plate 12 also includes a portion 20 disposed radially outwardly from the central portion 14. The portion 20 is preferably inclined at a relatively shallow angle from a planar configuration to facilitate the disposition of the abrasive wheel 10 against a workpiece surface (not shown) which is to be polished by the abrasive wheel. A tool 21 rotates the mandrel 18 and the abrasive wheel 10.

A plurality of abrasive flaps 22 are disposed on the portion 20 of the support plate 12. Each of the flaps 22 is formed from a thin strip of a backing material. Abrasive particles 24 are suitably secured to one surface of each of the flaps 22. The flaps 22 are disposed on one another in a partially overlapping relationship and are secured at their inner ends to the portion 20 of the support plate 12 as by a suitable material such as an epoxy 24. Adjacent flaps are substantially parallel to each other in the partially overlapping relationship along substantially the complete length of the flaps.

Because of the partially overlapping relationship, the outer portion of each of the flaps 22 extends outwardly beyond the adjacent flap on which it is disposed. Furthermore, because of this partially overlapping relationship, each of the flaps is disposed at an acute angle relative to the portion 20 of the support member 12. This causes the flaps 22 to have a rigid disposition even when the abrasive wheel 10 is rotated against a workpiece surface to be polished.

The abrasive wheel 10 has certain advantages but also has significant disadvantages. The rigid relationship between the different flaps 22 causes the flaps to be effective in polishing a surface of a workpiece when the portion 20 of the support plate 12 is disposed against the surface. However, the support plate 12 cannot be disposed against all surfaces because of the disposition of the support plate in the form of a disc.

FIGS. 4–7 show an abrasive wheel, generally indicated at 30, constituting one embodiment of the invention. The abrasive wheel 30 includes a support member 32 which may be made from a suitable material such as fibers disposed in two (2) transverse (preferably perpendicular) directions in an interlocking relationship. This interlocking relationship may be defined by each fiber in one direction extending over alternate fibers, and then under the other fibers, in the second (or transverse) direction. Different warp and woof relationships in the fibers may be provided than that specified above without departing from the scope of the invention.

The support member 32 has a central hole 34. A support plate 36 also has a central hole 38. The support plate 36 is disposed on the support member 32 so that the central hole 34 in the support member and the central hole 38 in the support plate are aligned. The support plate 36 includes a protuberance 40 which defines an extension of the hole 38. This extension is internally threaded as at 41 to receive the threads on a mandrel (not shown) for rotating the abrasive wheel 30. The support plate 36 is disposed against one surface of the support member 32 and a flange 42 integral with the support plate is disposed against the other surface of the support member to maintain a fixed relationship between the support member and the support plate.

The support member 32 preferably has a disc-like configuration. A plurality of flaps 44 are attached as by an epoxy 45 to the support member 32 at the outer periphery of the support member. Abrasive particles 46 are suitably attached to one surface of each of the support flaps 44. The flaps 44 are disposed on the support member 32 in a partially overlapping relationship similar to that specified above for the prior art embodiment shown in FIGS. 1–3. In this relationship, the inner ends of the flaps 44 are attached to the support member 32 at the outer radial extremity of the support member and the outer ends of the flaps are exposed so that the abrasive particles 46 face outwardly.

The axial dimension of each of the flaps 44 is preferably greater than the axial width of the support member 32. Preferably the flaps 44 are disposed on the support member 32 so that the flaps 44 extend axially beyond the support member 32 at the opposite axial ends of each of the side surfaces of the support member. For example, when the support member has a diameter of approximately four (4) inches and the support member has a thickness of approximately one quarter of an inch (¼"), the flaps 44 may have an axial dimension of approximately one (1) inch. Preferably the axial extension of the flaps 44 beyond the support member 32 is equal on the opposite sides of the support member.

Each of the flaps 44 may preferably have a length of approximately five eighths of an inch (⅝"). Each flap may overlap the adjacent flap by a distance of approximately three eighths of an inch (⅜") and may extend beyond such adjacent flap by a distance of approximately three sixteenths of an inch (3/16"). In the overlapping relationship, each of the flaps 44 is disposed at an acute angle relative to the annular periphery of the support member 32 at the position at which such flap is attached as by the epoxy 45 to the support surface.

The abrasive wheel 30 has certain important advantages. It is able to polish surfaces not capable of being polished by the abrasive wheels of the prior art. This results from the extension of the abrasive flaps 44 in the axial direction beyond the axial periphery of the support member 32 at the opposite axial ends of the support member.

The effective abrading action of the abrasive wheel 30 shown in FIGS. 4–7 additionally results from the firm and solid relationship between the adjacent flaps 44 around the annulus defined by the flaps even at the axial positions of the flaps beyond the support member 32. Because of this firm and solid relationship, the flaps 44 are able to provide an effective polishing action on the workpiece surface when such workpiece surface is contacted by such flaps.

Figure 8:
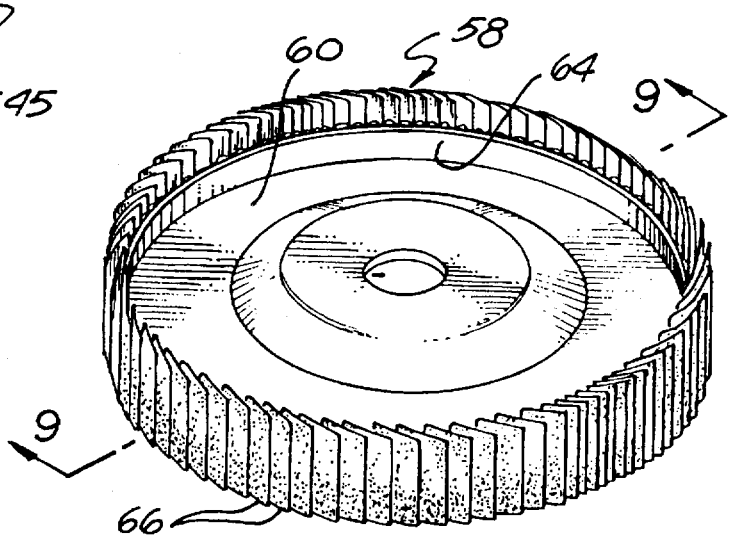
FIG. 8 is a perspective view of an abrasive wheel constituting a second embodiment of the invention and shows a support member and abrasive flaps on the support member.
Figure 10:
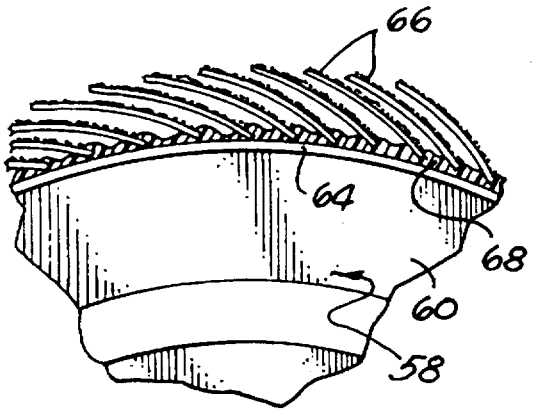
FIG. 10 is an enlarged fragmentary sectional view taken substantially on the line 10—10 of FIG. 9 and shows additional details of the interrelationship between the support member and the flaps.
Figure 9:
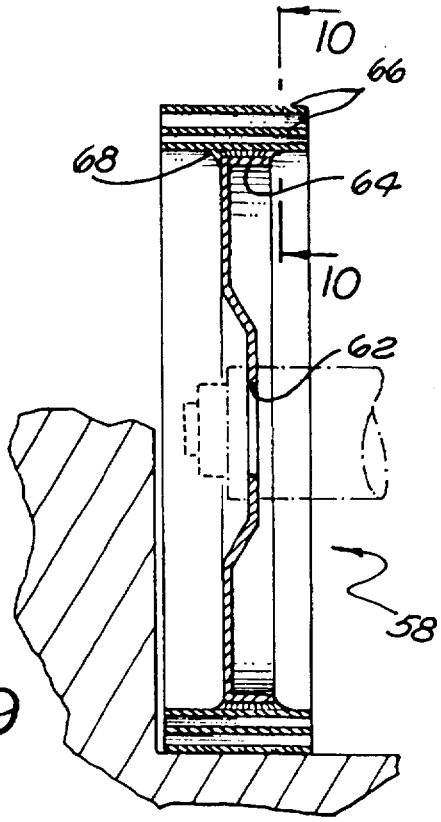
FIG. 9 is a sectional view taken substantially on the line 9—9 of FIG. 8 and shows additional details of the interrelationship between the support member and the flaps.

FIGS. 8–10 show an abrasive wheel, generally indicated at 58, constituting a second embodiment of the invention. In this embodiment, a support plate 60 having a disc-like configuration is provided with a central hole 62 for receiving a mandrel (not shown) and with an annular flange 64 at the radially outward end of the support plate. Flaps 66 corresponding to the flaps 44 (FIGS. 4–7) are attached as by an epoxy 68 to the flange 64 at the inner ends of the flaps. Successive ones of the flaps 66 may have a partially overlapping relationship with respect to the adjacent flap corresponding to the partially overlapping relationship of the flaps 44. The flaps 66 preferably extend axially beyond the flange 64 at the opposite axial ends of the flaps.

The embodiment shown in FIGS. 8–10 has all of the advantages discussed above for the embodiment shown in FIGS. 4–7. In addition, the embodiment shown in FIGS. 8–10 has a simpler construction than the embodiment shown in FIGS. 4–7. This results in part from the replacement of the support member 32 and the support plate 36 in FIGS. 4–7 by the support plate 60 in FIGS. 8–10. The embodiment shown in FIGS. 7–10 is also advantageous in that the flange 64 on the support plate 60 provides a firm support for the flaps 66.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

I claim:

1. An abrasive wheel for abrading a surface of a workpiece in accordance with a rotation of the wheel, including, a substantially rigid rotary member, first means extending radially from the rotary member and having an annular periphery at its outer radial end and having an annular rim at its outer radial periphery, the annular rim having a width extending axially beyond the first means to define opposite axial ends of the rim, a plurality of flaps each having an inner end and an outer end and each extending along the width of the rim and each extending from the annular rim at an angle relative to the annular rim and each disposed at least partially on an adjacent one of the flaps in an overlapping relationship in the radial direction with such adjacent ones of the flaps before the rotation of the wheel, the flaps being disposed around the complete periphery of the annular rim and being substantially parallel to one another in the overlapping relationship along the lengths of the flaps, and second means for attaching the flaps to the annular rim at the inner ends of the flaps along the width of the rim to retain the flaps in a substantially fixed relationship to one another and to the annular rim, with each flap disposed at the angle relative to the annular rim and with each flap disposed on an adjacent one of the flaps, during the rotation of the abrasive wheel and the application of the wheel against the workpiece surface.

2. An abrasive wheel as set forth in claim 1 wherein each of the flaps is disposed on the annular rim at an acute angle relative to the annular rim at the position at which it is attached to the annular rim.

3. An abrasive wheel as set forth in claim 1 wherein the flaps extend axially beyond the annular rim at the opposite axial ends of the annular rim and extend at the positions beyond the annular rim in a direction having a component extending radially outwardly from the annular rim.

4. An abrasive wheel as set forth in claim 1 wherein the second means constitutes an epoxy attached to the inner ends of the abrasive flaps at the position at which the abrasive flaps abut the annular rim.

5. An abrasive wheel as set forth in claim 2 wherein the periphery of the flaps extends axially beyond the annular rim at the opposite axial ends of the annular rim and wherein the second means constitutes an epoxy attached to the inner ends of the abrasive flaps at the position at which the abrasive flaps abut the annular rim and wherein the abrasive flaps extend at the positions beyond the annular rim in a direction having a component extending radially outwardly from the annular rim.

6. An abrasive wheel as set forth in claim 1, including, the angle between each flap and the annular rim providing for a partially overlapping relationship between each flap and the adjacent flaps.

7. An abrasive wheel for abrading a surface of a workpiece, including, a substantially rigid member having a looped configuration and having a first portion disposed in a radial plane and having an outer end and having a second portion extending axially from the first portion at the outer end of such radial plane, a plurality of flaps having inner and outer ends and disposed on one another on the second portion of the member at their inner ends in a partially overlapping relationship to one another in the radial direction at positions between the inner and outer ends of the flaps, the flaps being disposed completely around the looped configuration of the member, adjacent ones of the flaps being disposed in a substantially parallel relationship to each other in the partially overlapping relationship along substantially the complete lengths of the flaps, and means disposed on the flaps in abutting relationship to the member for retaining the inner ends of the flaps on the second portion of the member in the overlapping relationship during the rotation of the abrasive wheel and the application of the abrasive wheel against the surface of the workpiece.

8. An abrasive wheel as set forth in claim 7 wherein the first portion of the member has opposite axial ends and wherein the second portion of the member extends axially beyond the first portion of the member at the opposite axial ends of the first portion of the member and wherein the flaps extend axially beyond the second portion of the member at the opposite axial ends of the second portion of the member in a direction having a component extending radially outwardly from the annular rim.

9. An abrasive wheel as set forth in claim 7 wherein the retaining means constitutes an epoxy disposed on the flaps and the second portion of the member at the inner ends of the flaps and disposed relative to the second portion of the member for bonding the inner ends of the flaps to the second portion of the member.

10. An abrasive wheel as set forth in claim 7 wherein the flaps extend with a directional component radially outwardly from the second portion of the member at an acute angle relative to the second portion of the member in the partially overlapping relationship of the flaps at the positions between the inner and outer ends of the flaps.

11. An abrasive wheel as set forth in claim 8 wherein the retaining means constitutes an epoxy disposed on the flaps at the inner ends of the flaps and disposed relative to the second portion of the member for bonding the inner ends of the flaps to the second portion of the member and wherein the flaps extend with a directional component radially outwardly from the second portion of the member at an acute angle relative to the second portion of the member in the partially overlapping relationship of the flaps in the radial direction at the positions between the inner and outer ends of the flaps.

12. An abrasive wheel as set forth in claim 10 wherein the acute angle between the flaps and the second portion of the member provides a partially overlapping relationship in the radial direction between each flap and at least two (2) of the adjacent flaps in the plurality at the positions between the inner and outer ends of such flaps.

13. An abrasive wheel for abrading a surface of a workpiece in accordance with a rotation of the wheel, including, a substantially rigid support plate extending in a radial direction and having an outer periphery and having an axially disposed substantially rigid rim at its outer periphery, the rim having an annular configuration, a plurality of abrasive flaps having inner and outer ends and disposed on one another at their inner ends on the axially disposed rim in a partially overlapping relationship to one another in the radial direction before any rotation of the wheel, adjacent ones of the flaps being disposed in a substantially parallel relationship to each other in the overlapping relationship along substantially the complete lengths of the flaps, and means for attaching the inner ends of the flaps to the radially disposed rim in the overlapping relationship of the abrasive flaps before any rotation of the wheel, the flaps being disposed around the complete annular configuration of the rim.

14. An abrasive wheel as set forth in claim 13 wherein the attaching means is an epoxy and the support plate is metallic.

15. An abrasive wheel as set forth in claim 13 wherein the abrasive flaps are disposed at an acute angle relative to the axially disposed rim and wherein the flaps are provided with abrasive particles on one of its surfaces and wherein the surface with the abrasive particles on each of the flaps faces outwardly from the axially disposed rim.

16. An abrasive wheel as set forth in claim 13 wherein the support plate is provided with a centrally disposed hole to receive a mandrel for rotating the support plate, the abrasive flaps and the attaching means.

17. An abrasive wheel as set forth in claim 13 wherein the abrasive flaps extend axially beyond the opposite axial ends of the axially disposed rim in a direction having a component extending radially outwardly from the annular rim and wherein the overlapping relationship of the flaps in the radial direction before any rotation of the wheel causes the disposition of the flaps to be rigid even at the axial positions of the flaps beyond the opposite axial ends of the axially disposed rim.

18. An abrasive wheel as set forth in claim 13 wherein the inner ends of the plurality of the abrasive flaps are disposed on the axially disposed rim to provide an overlapping relationship in the radial direction between each flap and at least two (2) of the flaps contiguous to such flap before any rotation of the wheel.

19. An abrasive wheel as set forth in claim 17 wherein the attaching means is an epoxy and the support plate is metallic and wherein the abrasive flaps are disposed at an acute angle in the radial direction relative to the axially disposed rim and wherein the flaps are provided with abrasive particles on one of its surfaces and wherein the surface with the abrasive particles on each of the flaps faces outwardly from the axially disposed rim and wherein the support plate is provided with a centrally disposed hole to receive a mandrel for rotating the support plate, the abrasive flaps and the attaching means and wherein the plurality of the abrasive flaps are disposed on the axially disposed rim to provide an overlapping relationship in the radial direction between each flap and at least two (2) of the flaps contiguous to such flap before any rotation of the wheel.

20. An abrasive wheel for abrading a surface of a workpiece in accordance with a rotation of the wheel, including, a radially disposed substantially rigid support plate, a substantially rigid fibrous member attached to the support plate and extending radially outwardly from the support plate and defining an axially extending substantially rigid rim at the radially outward end of the fibrous member, the rim having a closed configuration a plurality of abrasive flaps having inner and outer ends and disposed at least partially on one another at their inner ends on the axially extending rim in an overlapping relationship to the adjacent flaps in the plurality before any rotation of the wheel, adjacent ones of the flaps being disposed in a substantially parallel relationship to each other in the overlapping relationship along substantially the complete lengths of the flaps, and means for attaching the flaps to the axially extending rim at the inner ends of the flaps abutting the rim, the flaps being disposed completely around the closed configuration of the rim.

21. An abrasive wheel as set forth in claim 20, including, the plurality of the abrasive flaps being disposed on the axially extending rim to provide an overlapping relationship in the radial direction between each flap and at least two (2) of the flaps contiguous to such flap before any rotation of the wheel.

22. An abrasive wheel as set forth in claim 20, the attaching means constituting first attaching means, and second means for attaching the fibrous member to the support plate.

23. An abrasive wheel as set forth in claim 22, the support plate being made from a metal, and the first and second attaching means constituting an epoxy.

24. An abrasive wheel as set forth in claim 21, including, the attaching means constituting first attaching means, and second means for attaching the fibrous member to the support plate, the support plate being made from a metal, and the first and second attaching means constituting an epoxy.

25. An abrasive wheel as set forth in claim 24, the abrasive flaps extending in the axial direction beyond the axial ends of the axially extending rim in a direction having a component extending radially outwardly from the rim and the overlapping relationship between the flaps before any rotation of the wheel providing for a rigid relationship between the flaps even at the axial positions of the flaps beyond the axial ends of the axially extending rims.

* * * * *